US009993059B2

(12) United States Patent
Langdon et al.

(10) Patent No.: US 9,993,059 B2
(45) Date of Patent: Jun. 12, 2018

(54) ROLLER APPLICATOR

(71) Applicant: HCT GROUP HOLDINGS LIMITED, Central (HK)

(72) Inventors: Megan Rene Langdon, Los Angeles, CA (US); Kamaal Washington, Los Angeles, CA (US); Denis Pierre Maurin, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 34 days.

(21) Appl. No.: 15/204,116

(22) Filed: Jul. 7, 2016

(65) Prior Publication Data

US 2017/0007000 A1 Jan. 12, 2017

Related U.S. Application Data

(60) Provisional application No. 62/244,379, filed on Oct. 21, 2015, provisional application No. 62/191,228, filed on Jul. 10, 2015.

(51) Int. Cl.
*A45D 34/04* (2006.01)
*A45D 40/26* (2006.01)

(52) U.S. Cl.
CPC ..... *A45D 34/041* (2013.01); *A45D 34/04* (2013.01); *A45D 40/26* (2013.01); *A45D 40/261* (2013.01)

(58) Field of Classification Search
CPC combination set(s) only.
See application file for complete search history.

(56) References Cited

U.S. PATENT DOCUMENTS

| | | | |
|---|---|---|---|
| 118,223 | A | 8/1871 | Evans |
| 753,968 | A | 3/1904 | Farmer |
| 776,468 | A | 11/1904 | Hosmer |
| 1,030,440 | A | 6/1912 | Waterman |
| 1,065,879 | A | 6/1913 | Krebs |
| 1,067,596 | A | 7/1913 | Fesler |
| 1,112,193 | A | 9/1914 | Carleton et al. |
| 1,156,456 | A | 10/1915 | Beck |
| 1,170,923 | A | 2/1916 | Malkin |

(Continued)

FOREIGN PATENT DOCUMENTS

| | | | |
|---|---|---|---|
| CN | 2606543 | Y | 3/2004 |
| CN | 1499988 | A | 5/2004 |

(Continued)

OTHER PUBLICATIONS

Affidavit of Armando Villarreal, State of California, County of Los Angeles, Mar. 19, 2013, 4 pages.

(Continued)

*Primary Examiner* — David Walczak
(74) *Attorney, Agent, or Firm* — Seager, Tufte & Wickhem LLP

(57) ABSTRACT

Illustrative applicators include a roller controllably coupled to a reservoir by a wicking agent such as a felt applicator insert. A cap for the applicator is also provided. The action of the cap being placed over the roller brings the roller into contact with the wicking agent, applying product contained in the reservoir to the roller. Removing the cap causes the roller to move out of contact with the wicking agent, allowing a quantity of product applied to the roller while the cap is on the applicator to be used.

20 Claims, 3 Drawing Sheets

(56) References Cited

U.S. PATENT DOCUMENTS

| | | | |
|---|---|---|---|
| 1,188,214 | A | 6/1916 | Sohn |
| 1,274,697 | A | 8/1918 | Dynowsky |
| 1,355,026 | A | 10/1920 | Austin |
| 1,357,306 | A | 11/1920 | Aste |
| 1,358,597 | A | 11/1920 | Leon |
| 1,365,246 | A | 1/1921 | Kendall |
| 1,462,034 | A | 7/1923 | Finlayson |
| 1,506,292 | A | 8/1924 | Corsello |
| 1,616,381 | A | 2/1927 | Macdougall |
| 1,620,002 | A | 3/1927 | Barany |
| 1,626,992 | A | 5/1927 | Willk |
| 1,639,388 | A | 8/1927 | Stebbings |
| 1,642,780 | A | 9/1927 | Kole et al. |
| 1,659,800 | A | 2/1928 | Bailey |
| 1,668,658 | A | 5/1928 | Reutter |
| 1,709,445 | A | 4/1929 | Tomes |
| 2,055,389 | A | 9/1936 | Rosenberg |
| D104,300 | S | 4/1937 | Wolfsheim |
| 2,321,265 | A | 6/1943 | Ulvick |
| 2,459,733 | A | 1/1949 | Macy |
| D156,948 | S | 1/1950 | Fisher |
| 2,518,382 | A | 8/1950 | Ruthsatz |
| 2,600,426 | A | 6/1952 | Paul |
| 2,697,642 | A | 12/1954 | Rudy |
| 2,701,659 | A | 2/1955 | Baltosser |
| 2,725,038 | A | 11/1955 | Morris |
| 2,755,968 | A | 7/1956 | Fiant |
| 2,816,308 | A | 12/1957 | Schultz |
| 2,817,451 | A | 12/1957 | Giles et al. |
| 2,825,080 | A | 3/1958 | Bongiovanni |
| 2,866,993 | A | 1/1959 | Edelstone |
| 2,976,897 | A | 3/1961 | Beckworth |
| 2,982,987 | A | 5/1961 | Knapp |
| 2,990,086 | A | 6/1961 | Williams |
| 3,028,868 | A | 4/1962 | Tandler, Jr. |
| 3,039,132 | A | 6/1962 | Colman |
| 3,095,598 | A | 7/1963 | Gonnella et al. |
| 3,100,589 | A | 8/1963 | Love, Jr. |
| 3,111,736 | A | 11/1963 | Budreck |
| 3,183,538 | A | 5/1965 | Otto |
| 3,235,900 | A | 2/1966 | Klassen |
| D204,449 | S | 4/1966 | Zavodsky |
| 3,256,550 | A | 6/1966 | Laxalt |
| 3,259,935 | A | 7/1966 | Miller |
| 3,276,642 | A | 10/1966 | Johnson, Jr. |
| 3,282,473 | A | 11/1966 | Moore |
| 3,337,901 | A | 8/1967 | Schefer et al. |
| 3,342,379 | A | 9/1967 | Foley |
| D209,098 | S | 10/1967 | Spiess |
| 3,363,775 | A | 1/1968 | Shaw |
| 3,536,333 | A | 10/1970 | Gits et al. |
| 3,552,402 | A | 1/1971 | Levy |
| 3,602,601 | A | 8/1971 | Zenger et al. |
| 3,644,707 | A | 2/1972 | Costello |
| 3,710,985 | A | 1/1973 | Baum |
| 3,729,011 | A | 4/1973 | Gleicher |
| 3,734,106 | A | 5/1973 | Zimmerman |
| 3,733,634 | A | 8/1973 | Golbe |
| 3,774,231 | A | 11/1973 | Tullos |
| D230,137 | S | 1/1974 | Bettonica |
| 3,837,749 | A | 9/1974 | Spatz |
| 3,850,183 | A | 11/1974 | Gruska |
| 3,891,827 | A | 6/1975 | Wyse |
| D239,160 | S | 3/1976 | Giberstein |
| 4,027,348 | A | 6/1977 | Flowers |
| 4,029,422 | A | 6/1977 | Pillsbury |
| D245,398 | S | 8/1977 | Grodin |
| 4,056,707 | A | 11/1977 | Farnam |
| 4,129,391 | A | 12/1978 | Gamacher et al. |
| 4,147,284 | A | 4/1979 | Mizzi et al. |
| 4,159,789 | A | 7/1979 | Stoody et al. |
| 4,165,755 | A | 8/1979 | Cassai |
| 4,182,497 | A | 1/1980 | Ferreira |
| 4,224,958 | A | 9/1980 | Kaplan et al. |
| 4,291,685 | A | 9/1981 | Taelman |
| 4,310,108 | A | 1/1982 | Motoyama et al. |
| 4,312,333 | A | 1/1982 | Dreybus |
| D268,097 | S | 3/1983 | Thompson |
| 4,428,388 | A | 1/1984 | Cassai et al. |
| 4,441,629 | A | 4/1984 | Mackal |
| 4,446,880 | A | 5/1984 | Gueret et al. |
| 4,456,155 | A | 6/1984 | Miyata et al. |
| 4,465,073 | A | 8/1984 | Schwob |
| 4,470,715 | A | 9/1984 | Reuchin |
| 4,511,427 | A | 4/1985 | Karliner |
| D281,281 | S | 11/1985 | Matalon |
| 4,551,038 | A | 11/1985 | Baker |
| 4,592,745 | A | 6/1986 | Rex et al. |
| 4,602,741 | A | 7/1986 | Faulkner, III et al. |
| 4,603,448 | A | 8/1986 | Middleton et al. |
| 4,626,119 | A | 12/1986 | Ladd, Jr. et al. |
| 4,630,954 | A | 12/1986 | Ladd, Jr. et al. |
| 4,630,955 | A | 12/1986 | Ladd, Jr. et al. |
| 4,647,240 | A | 3/1987 | Ladd, Jr. et al. |
| 4,648,732 | A | 3/1987 | Smialkowski |
| 4,652,162 | A | 3/1987 | Ladd, Jr. et al. |
| 4,671,431 | A | 6/1987 | Obrist |
| 4,671,690 | A | 6/1987 | Ladd, Jr. et al. |
| 4,674,537 | A | 6/1987 | Bergmann |
| 4,681,127 | A | 7/1987 | Gueret |
| 4,696,317 | A | 9/1987 | Shioi et al. |
| 4,704,088 | A | 11/1987 | Newman |
| 4,708,267 | A | 11/1987 | Sieverding et al. |
| D293,834 | S | 1/1988 | White et al. |
| 4,728,211 | A | 3/1988 | Ladd, Jr. et al. |
| 4,869,612 | A | 9/1989 | Mooney et al. |
| D303,927 | S | 10/1989 | Weber |
| 4,874,117 | A | 10/1989 | Kay et al. |
| 4,877,157 | A | 10/1989 | Saulle |
| 4,880,326 | A | 11/1989 | Spivey |
| 4,888,668 | A | 12/1989 | Roll |
| 4,906,120 | A | 3/1990 | Sekiguchi et al. |
| 4,909,265 | A | 3/1990 | Goncalves |
| D307,191 | S | 4/1990 | Blutenthal |
| 4,917,132 | A | 4/1990 | Tuchman |
| 4,927,281 | A | 5/1990 | Gueret et al. |
| 4,940,350 | A | 7/1990 | Kim et al. |
| 4,983,059 | A | 1/1991 | Holloway |
| D317,407 | S | 6/1991 | Gray et al. |
| 5,025,960 | A | 6/1991 | Seager |
| D319,105 | S | 8/1991 | Cheng |
| 5,050,276 | A | 9/1991 | Pemberton |
| 5,063,947 | A | 11/1991 | Gueret et al. |
| D324,994 | S | 3/1992 | Jentgen |
| 5,107,871 | A | 4/1992 | Butcher et al. |
| 5,107,984 | A | 4/1992 | Welschoff |
| 5,116,154 | A | 5/1992 | Fulkerson |
| 5,116,156 | A | 5/1992 | Landi |
| 5,137,038 | A | 8/1992 | Kingsford et al. |
| 5,165,760 | A | 11/1992 | Gueret et al. |
| 5,180,244 | A | 1/1993 | Hirose |
| D337,207 | S | 7/1993 | Tiramani et al. |
| 5,301,838 | A | 4/1994 | Schmidt et al. |
| 5,302,043 | A | 4/1994 | Velliquette et al. |
| 5,316,196 | A | 5/1994 | Reich |
| 5,328,282 | A | 7/1994 | Charrier et al. |
| 5,339,483 | A | 8/1994 | Byun et al. |
| D350,836 | S | 9/1994 | Chevassus |
| D355,363 | S | 2/1995 | Iorii et al. |
| 5,482,059 | A | 1/1996 | Miraglia |
| 5,514,135 | A | 5/1996 | Earle |
| 5,515,876 | A | 5/1996 | Warner et al. |
| 5,531,763 | A | 7/1996 | Mastri et al. |
| 5,535,925 | A | 7/1996 | Hinden et al. |
| 5,570,813 | A | 11/1996 | Clark, II |
| 5,598,929 | A | 2/1997 | Jensen et al. |
| 5,626,472 | A | 5/1997 | Pennetta |
| 5,690,441 | A | 11/1997 | McManus |
| D389,064 | S | 1/1998 | Sethi et al. |
| 5,704,378 | A | 1/1998 | Machelett |
| 5,769,234 | A | 6/1998 | Gueret |
| D400,009 | S | 10/1998 | Conway |
| 5,816,728 | A | 10/1998 | Nardolillo et al. |
| 5,836,320 | A | 11/1998 | Gueret et al. |

(56) References Cited

U.S. PATENT DOCUMENTS

D405,684 S 2/1999 Gager et al.
D408,626 S 4/1999 Lage
D411,749 S 6/1999 Nahum-Albright
5,934,816 A 8/1999 Bruttomesso
5,950,638 A 9/1999 Crosota
5,951,185 A 9/1999 Kingsford et al.
D416,491 S 11/1999 Gobe
5,975,368 A 11/1999 Wood
5,988,185 A 11/1999 Gueret et al.
5,992,423 A 11/1999 Tevolini
D417,752 S 12/1999 Bakic
D418,253 S 12/1999 Bakic
6,009,887 A 1/2000 Hertel
6,010,264 A 1/2000 Scuderi et al.
D419,865 S 2/2000 Gager et al.
6,027,272 A 2/2000 Spencer
6,035,865 A 3/2000 Krieger
D422,139 S 4/2000 Meikle
6,053,183 A 4/2000 Rizzo
D425,669 S 5/2000 Gavin
6,062,757 A 5/2000 Gueret
6,068,421 A 5/2000 Pierpont
6,070,597 A 6/2000 Motherhead
D427,424 S 7/2000 Conway
D429,424 S 8/2000 Vanderminden, Sr.
6,102,518 A 8/2000 Taylor
6,102,602 A 8/2000 Kageyama
D432,784 S 10/2000 Conway
D433,189 S 10/2000 Schoon et al.
6,126,352 A 10/2000 Wiley et al.
6,129,469 A 10/2000 Messer et al.
6,138,687 A 10/2000 Sheffler et al.
6,139,553 A 10/2000 Dotan
D433,537 S 11/2000 Schoon et al.
D434,187 S 11/2000 Schoon et al.
6,142,695 A 11/2000 Byun
6,145,514 A 11/2000 Clay et al.
6,149,008 A 11/2000 Yuhara
6,164,857 A 12/2000 Wolfarth-Brooks et al.
D436,434 S 1/2001 Conway
6,173,719 B1 1/2001 Petit
6,189,697 B1 2/2001 Davis
6,224,287 B1 5/2001 Gieux
6,261,014 B1 7/2001 Altobellis et al.
D447,694 S 9/2001 Leggett
6,283,172 B1 9/2001 Thurner
6,283,298 B1 9/2001 Seidler
6,287,034 B1 9/2001 Miraglia et al.
6,290,416 B1 9/2001 Gueret
6,309,124 B1 10/2001 Gueret
6,309,125 B1 10/2001 Peters
6,311,701 B1 11/2001 Yuhara et al.
6,332,482 B1 12/2001 Runge et al.
6,336,460 B2 1/2002 Yuhara
6,363,948 B2 4/2002 Choi
6,367,799 B1 4/2002 Sippel
6,402,411 B2 6/2002 Spencer et al.
6,418,939 B1 7/2002 Byun
D468,423 S 1/2003 Renfrew
D470,415 S 2/2003 Weber
6,532,970 B2 3/2003 Phue
6,546,937 B2 4/2003 Gueret
6,565,523 B1 5/2003 Gabourie
6,588,958 B1 7/2003 Seidler
6,591,842 B2 7/2003 Gueret
6,592,054 B2 7/2003 Prus
6,607,323 B2 8/2003 Breidenbach et al.
D483,418 S 12/2003 Carr et al.
6,669,389 B2 12/2003 Gueret
6,672,784 B2 1/2004 Baumann et al.
6,681,936 B2 1/2004 Godshaw et al.
6,758,374 B2 7/2004 Albisetti
6,769,572 B1 8/2004 Cullotta
6,789,970 B1 9/2004 Shearon et al.
6,789,974 B2 9/2004 Atkinson et al.
6,793,431 B1 9/2004 Tsai
6,831,541 B1 12/2004 Seidler
6,866,046 B2 3/2005 Gueret
6,872,020 B2 3/2005 Epli
6,923,589 B2 8/2005 Blackwell
6,926,151 B1 8/2005 Perry et al.
6,929,159 B1 8/2005 Haig
6,935,541 B1 8/2005 Campbell et al.
6,935,802 B1 8/2005 Byun
6,942,412 B2 9/2005 Gueret
6,945,403 B2 9/2005 Lombardi
6,974,513 B2 12/2005 Kepka
7,028,843 B2 4/2006 Byun
7,040,830 B2 5/2006 Kliegman
D526,121 S 8/2006 Nip
D527,180 S 8/2006 Raile
7,082,970 B2 8/2006 Bartholomew
7,083,347 B2 8/2006 Marcotte
7,100,806 B2 9/2006 Schuster et al.
7,101,107 B1 9/2006 Byun
7,108,441 B2 9/2006 Altonen et al.
D532,637 S 11/2006 Bassett et al.
D532,936 S 11/2006 Bakic
D533,309 S 12/2006 Nobuto et al.
7,163,130 B2 1/2007 Lafond
D537,180 S 2/2007 Hsu
7,172,357 B2 2/2007 Gueret
D538,480 S 3/2007 Chen
7,188,753 B2 3/2007 Campbell
7,234,474 B2 6/2007 Byun
7,237,973 B1 7/2007 Lou
D553,355 S 10/2007 Mosteller
D554,291 S 10/2007 Darnell et al.
7,282,037 B2 10/2007 Cho
D555,831 S 11/2007 Chan
7,306,442 B2 12/2007 Fox
7,316,235 B2 1/2008 Maio et al.
7,334,709 B1 2/2008 Huang
7,344,327 B2 3/2008 Gueret
D570,545 S 6/2008 Althoff et al.
D572,476 S 7/2008 Raile
7,398,898 B2 7/2008 Bouix
7,419,323 B1 9/2008 Zhang
7,422,389 B2 * 9/2008 Abergel ..... A45D 34/041 401/208
7,429,141 B2 9/2008 Habatjou
7,461,993 B1 12/2008 Sampaio
7,467,905 B2 12/2008 Habatjou
7,494,030 B2 2/2009 Bennett
7,524,125 B2 4/2009 Lambert
D594,320 S 6/2009 Tanaka et al.
D598,655 S 8/2009 Thorpe et al.
7,614,404 B2 11/2009 Kee
7,628,559 B2 12/2009 Petit
7,638,144 B2 12/2009 Rhaodes
D608,205 S 1/2010 Bartholomeu et al.
7,677,827 B1 3/2010 Manukian
D617,050 S 6/2010 Lou
D620,808 S 8/2010 Gieux
7,775,737 B2 8/2010 Deans et al.
7,785,026 B2 8/2010 Eng
7,794,168 B2 9/2010 Chang
7,854,562 B2 12/2010 Peterson et al.
D631,192 S 1/2011 Lim
7,866,758 B2 1/2011 Jang
D632,014 S 2/2011 Lee
7,878,727 B2 2/2011 Koptis
7,883,287 B2 2/2011 Thorpe
D633,653 S 3/2011 Lee
7,918,620 B2 4/2011 Del Ponte
7,927,032 B2 4/2011 Sanchez
D639,664 S 6/2011 Thorpe et al.
7,959,369 B2 6/2011 Gueret
D643,294 S 8/2011 Thorpe et al.
8,006,707 B2 8/2011 Thorpe et al.
8,025,067 B2 9/2011 Thorpe et al.
8,028,707 B2 10/2011 Wyatt et al.
8,074,665 B2 12/2011 Pires
D653,805 S 2/2012 Tani

(56) References Cited

U.S. PATENT DOCUMENTS

| | | | |
|---|---|---|---|
| 8,118,040 | B2 | 2/2012 | Bennett |
| 8,132,578 | B2 | 3/2012 | LoPrete |
| 8,161,983 | B1 | 4/2012 | Lee |
| D663,483 | S | 7/2012 | Lee |
| 8,210,187 | B1 | 7/2012 | Zhang |
| 8,267,606 | B2 | 9/2012 | Delbove et al. |
| 8,286,648 | B2 | 10/2012 | Thorpe et al. |
| 8,292,535 | B2 | 10/2012 | Thorpe |
| 8,360,674 | B2 | 1/2013 | Dwyer |
| 8,387,627 | B2 | 3/2013 | Yeom |
| 8,499,970 | B2 | 8/2013 | Yoo |
| 8,517,622 | B2 | 8/2013 | Apodaca et al. |
| 8,540,449 | B2 | 9/2013 | Song |
| 8,573,874 | B2 | 11/2013 | Neuner |
| 8,678,222 | B2 | 3/2014 | Thorpe et al. |
| D704,066 | S | 5/2014 | de Lima Paschoal et al. |
| 8,714,857 | B1 | 5/2014 | Liu |
| 8,839,803 | B2 | 9/2014 | Holloway |
| 8,864,401 | B2 | 10/2014 | Duru |
| 9,016,600 | B2 | 4/2015 | Pearson et al. |
| 9,016,968 | B2 | 4/2015 | Thorpe |
| 2001/0037815 | A1 | 11/2001 | Gueret |
| 2001/0047949 | A1 | 12/2001 | Bono |
| 2002/0014246 | A1 | 2/2002 | Choi |
| 2002/0029859 | A1 | 3/2002 | Weaver |
| 2002/0040720 | A1 | 4/2002 | Byun |
| 2002/0056660 | A1 | 5/2002 | Gueret |
| 2002/0082625 | A1 | 6/2002 | Huxel et al. |
| 2002/0117423 | A1 | 8/2002 | Jackson |
| 2002/0121239 | A1 | 9/2002 | Tonazzi et al. |
| 2002/0166631 | A1 | 11/2002 | Dewitt |
| 2002/0185396 | A1 | 12/2002 | Mainwaring et al. |
| 2003/0024545 | A1 | 2/2003 | Delage |
| 2003/0060925 | A1 | 3/2003 | Bartholomew et al. |
| 2003/0129363 | A1 | 7/2003 | Hoeft et al. |
| 2003/0154997 | A1 | 8/2003 | Lin |
| 2003/0171762 | A1 | 9/2003 | Forchette et al. |
| 2003/0231924 | A1 | 12/2003 | Libman et al. |
| 2004/0018037 | A1 | 1/2004 | Gueret |
| 2004/0034315 | A1 | 2/2004 | Chen |
| 2004/0089318 | A1 | 5/2004 | Tahara |
| 2004/0114988 | A1 | 6/2004 | Baumann et al. |
| 2004/0120753 | A1 | 6/2004 | Gieux |
| 2004/0127952 | A1 | 7/2004 | O'Phelan et al. |
| 2004/0129284 | A1 | 7/2004 | Abergel |
| 2004/0168700 | A1 | 9/2004 | Dorf |
| 2004/0190975 | A1 | 9/2004 | Goodman et al. |
| 2004/0211789 | A1 | 10/2004 | Osborn et al. |
| 2004/0222124 | A1 | 11/2004 | Byun |
| 2004/0249320 | A1 | 12/2004 | Yamazaki et al. |
| 2004/0250833 | A1 | 12/2004 | Jang |
| 2005/0000534 | A1 | 1/2005 | Tien |
| 2005/0011895 | A1 | 1/2005 | Lin |
| 2005/0031401 | A1 | 2/2005 | Gueret |
| 2005/0047848 | A1 | 3/2005 | Carraher |
| 2005/0175786 | A1 | 8/2005 | Singh et al. |
| 2005/0197268 | A1 | 9/2005 | Buskirk et al. |
| 2005/0224392 | A1 | 10/2005 | Perry et al. |
| 2005/0247740 | A1 | 11/2005 | Puzio |
| 2005/0249539 | A1 | 11/2005 | Habatjou |
| 2005/0268409 | A1 | 12/2005 | Blaustein et al. |
| 2005/0286967 | A1 | 12/2005 | Blauzdys |
| 2006/0026783 | A1 | 2/2006 | McKay |
| 2006/0032512 | A1 | 2/2006 | Kress et al. |
| 2006/0039742 | A1 | 2/2006 | Cable, Jr. et al. |
| 2006/0049203 | A1 | 3/2006 | Boone et al. |
| 2006/0093425 | A1 | 5/2006 | Gueret |
| 2006/0093426 | A1 | 5/2006 | Tsaur |
| 2006/0097011 | A1 | 5/2006 | Kou |
| 2006/0186019 | A1 | 8/2006 | Lu |
| 2006/0198686 | A1 | 9/2006 | Hetzel |
| 2006/0207627 | A1 | 9/2006 | Thorpe et al. |
| 2006/0216104 | A1 | 9/2006 | Bouix et al. |
| 2006/0216256 | A1 | 9/2006 | Giniger et al. |
| 2006/0222451 | A1 | 10/2006 | Glassman |
| 2006/0263144 | A1* | 11/2006 | Wang ..... B43K 5/10 401/209 |
| 2006/0272668 | A1 | 12/2006 | Wyatt et al. |
| 2006/0275072 | A1 | 12/2006 | Petit |
| 2006/0278665 | A1 | 12/2006 | Bennett |
| 2007/0014624 | A1 | 1/2007 | Fogelson et al. |
| 2007/0034224 | A1 | 2/2007 | Dumler |
| 2007/0071538 | A1 | 3/2007 | Doria |
| 2007/0084885 | A1 | 4/2007 | Conway et al. |
| 2007/0098485 | A1 | 5/2007 | Byun |
| 2007/0116509 | A1 | 5/2007 | Lin |
| 2007/0158372 | A1 | 7/2007 | Kurek et al. |
| 2007/0186950 | A1 | 8/2007 | Roeder |
| 2007/0186951 | A1 | 8/2007 | Gueret |
| 2007/0187284 | A1 | 8/2007 | Goto et al. |
| 2007/0199575 | A1 | 8/2007 | Del Ponte |
| 2007/0205233 | A1 | 9/2007 | Petit et al. |
| 2007/0228079 | A1 | 10/2007 | Vogel et al. |
| 2007/0235471 | A1 | 10/2007 | Radermacher |
| 2007/0272269 | A1 | 11/2007 | Wyatt et al. |
| 2007/0289602 | A1 | 12/2007 | Simmons |
| 2008/0011320 | A1 | 1/2008 | Bouix et al. |
| 2008/0060668 | A1 | 3/2008 | Legassie |
| 2008/0138138 | A1 | 6/2008 | Gueret |
| 2008/0166172 | A1 | 7/2008 | Eng et al. |
| 2008/0178903 | A1 | 7/2008 | Thorpe et al. |
| 2008/0193193 | A1 | 8/2008 | Pechko et al. |
| 2008/0264440 | A1 | 10/2008 | Thorpe |
| 2008/0283083 | A1 | 11/2008 | Piao |
| 2008/0286030 | A1 | 11/2008 | Roder |
| 2009/0071499 | A1 | 3/2009 | Wyatt et al. |
| 2009/0162131 | A1 | 6/2009 | Thorpe et al. |
| 2009/0183328 | A1 | 7/2009 | King |
| 2009/0188518 | A1 | 7/2009 | Thorpe et al. |
| 2009/0194120 | A1 | 8/2009 | Pires et al. |
| 2009/0194127 | A1 | 8/2009 | Pires et al. |
| 2009/0205673 | A1 | 8/2009 | Richardson |
| 2009/0272400 | A1 | 11/2009 | Park et al. |
| 2010/0017990 | A1 | 1/2010 | Piao |
| 2010/0028070 | A1 | 2/2010 | Gieux et al. |
| 2010/0037407 | A1 | 2/2010 | Telwar |
| 2010/0054844 | A1 | 3/2010 | Thorpe |
| 2010/0119290 | A1 | 5/2010 | Thorpe et al. |
| 2010/0178095 | A1 | 7/2010 | Bouix |
| 2010/0224208 | A1 | 9/2010 | Thorpe et al. |
| 2010/0236004 | A1 | 9/2010 | Xu |
| 2010/0300474 | A1 | 12/2010 | Tsai |
| 2011/0123248 | A1 | 5/2011 | Kim |
| 2011/0123252 | A1 | 5/2011 | Thorpe |
| 2011/0176856 | A1 | 7/2011 | Gardner et al. |
| 2011/0250008 | A1 | 10/2011 | Lim |
| 2011/0253166 | A1 | 10/2011 | Lin |
| 2012/0014736 | A1 | 1/2012 | Pires et al. |
| 2012/0065555 | A1 | 3/2012 | Chae et al. |
| 2012/0267390 | A1 | 10/2012 | Jeong et al. |
| 2012/0282008 | A1 | 11/2012 | Geuther et al. |
| 2013/0048658 | A1 | 2/2013 | Sawata |
| 2013/0068801 | A1 | 3/2013 | Lai |
| 2013/0087165 | A1 | 4/2013 | Lee et al. |
| 2013/0012174 | A1 | 5/2013 | Tarling et al. |
| 2013/0108350 | A1 | 5/2013 | Ulrich et al. |
| 2013/0121748 | A1 | 5/2013 | Ramirez |
| 2013/0134189 | A1 | 5/2013 | Kageyama et al. |
| 2013/0161345 | A1 | 6/2013 | Tatin |
| 2013/0343798 | A1 | 12/2013 | Delage et al. |
| 2013/0343800 | A1 | 12/2013 | Drugeon et al. |
| 2014/0145011 | A1 | 5/2014 | Brand et al. |
| 2014/0219701 | A1 | 8/2014 | Eberlein |
| 2014/0234004 | A1 | 8/2014 | Thorpe |
| 2014/0234010 | A1 | 8/2014 | Thorpe et al. |

FOREIGN PATENT DOCUMENTS

| | | | |
|---|---|---|---|
| CN | 1736816 | A | 2/2006 |
| CN | 2866193 | Y | 2/2007 |
| CN | 200941885 | Y | 9/2007 |
| CN | 201067174 | Y | 6/2008 |
| CN | 201131422 | Y | 10/2008 |
| CN | 101884463 | A | 11/2010 |

(56) References Cited

FOREIGN PATENT DOCUMENTS

| | | | |
|---|---|---|---|
| DE | 10038850 | A1 | 2/2002 |
| DE | 202008002070 | U1 | 5/2008 |
| EP | 0181184 | A2 | 5/1986 |
| EP | 1195106 | A1 | 4/2002 |
| EP | 2084986 | A2 | 8/2009 |
| EP | 2301379 | A1 | 3/2011 |
| FR | 1050060 | A | 1/1954 |
| FR | 2911766 | A1 | 8/2008 |
| GB | 798044 | A | 7/1958 |
| GB | 2404370 | A | 2/2005 |
| GB | 2446039 | A | 7/2008 |
| GB | 2463086 | A1 | 3/2010 |
| JP | 57018414 | A | 1/1982 |
| JP | 556487 | U | 7/1993 |
| JP | 8238884 | A | 9/1996 |
| JP | 9056462 | A | 3/1997 |
| JP | 3051335 | U1 | 6/1998 |
| JP | 10249253 | A | 9/1998 |
| JP | 2000102583 | A | 4/2000 |
| JP | 2000254575 | A | 9/2000 |
| JP | 2000279870 | A | 10/2000 |
| JP | 2001000497 | A | 1/2001 |
| JP | 2001190327 | A | 7/2001 |
| JP | 2002059044 | A | 2/2002 |
| JP | 2002306236 | A | 10/2002 |
| JP | 2003033228 | A | 2/2003 |
| JP | 2004222853 | A | 8/2004 |
| JP | 2005121103 | A | 5/2005 |
| JP | 2005211182 | A | 8/2005 |
| JP | 2005319300 | A | 11/2005 |
| JP | 2006247037 | A | 9/2006 |
| JP | 2006312083 | A | 11/2006 |
| JP | 2007068945 | A | 3/2007 |
| JP | 2008309807 | A | 5/2010 |
| JP | 2010110598 | A | 5/2010 |
| KR | 20-1998-056332 | U | 10/1998 |
| KR | 200322309 | Y1 | 8/2003 |
| KR | 20050000059 | A | 1/2005 |
| KR | 200398534 | Y1 | 10/2005 |
| KR | 20060026096 | A | 3/2006 |
| KR | 200432010 | Y1 | 11/2006 |
| KR | 20090004125 | A | 1/2009 |
| KR | 20090104593 | A | 10/2009 |
| KR | 2020120003955 | U | 6/2012 |
| WO | 9211785 | A1 | 7/1992 |
| WO | 0108529 | A2 | 2/2001 |
| WO | 0210029 | A1 | 2/2002 |
| WO | 2006101339 | A1 | 9/2006 |
| WO | 2007117091 | A1 | 10/2007 |
| WO | 2010098997 | A1 | 9/2010 |
| WO | 2011083427 | A2 | 7/2011 |
| WO | 2011086427 | A1 | 7/2011 |
| WO | 2012032148 | A1 | 3/2012 |
| WO | 2012071376 | A2 | 5/2012 |

OTHER PUBLICATIONS

Affidavit of Jenny Hsu—Attachment F, Park, "HCT produces metal tips for latest Dior cosmetics range," Packaging News, Sep. 3, 2009, retrieved at <<http://www.packagingnews.co.uk/design/hct-produces-metal-tips-for-latest-dior_cosmetics-range/>> 2 pages.

Affidavit of Jenny Hsu—Attachment G, "Vichy Neovvadiol Gf Lip & Eye Contour by HCT Packaging," Packaging Europe, Jun. 2011, 2 pages.

Affidavit of Jenny Hsu—Attachment H, "Armani Turns to HCT for New Eye Serum Packs," Packaging News, Sep. 26, 2011, 2 pages.

Affidavit of Jenny Hsu—Attachment I, "Armani Chose the HCT Patented Metal Tip Applicators for Their New Eye Serum," Packaging Europe, Sep. 2011, 2 pages.

Affidavit of Jenny Hsu—Attachment A, "2009 HBA IPDA Winners Annouced" Beauty Packaging Magazine, Oct./Nov. 2009, retrieved at <<http://www.beautypackaging.com/articles/2009/10/2009-hba-ipda-winners-announced>> 3 pages.

Affidavit of Jenny Hsu—Attachment B, "Cosmetic/Personal Care Packaging, 2009 Editor's Choice Award Winner: Personal Care," Cosmetic & Personal Care Packagining Magazine I USA, May 2009, retrieved at <<http://www.cpcpkg.com/magazine/09_05_perfekt.php>> 3 pages.

Affidavit of Jenny Hsu, Attachment C, "Cosmoprof Bologna Draws Growing International Crowd," BeautyPackaging Magazine, Apr./May 2012, retrieved at <<http://beta.nutraceuticalsworld.com/articles/2012/05/cosmoprof-bologna-draws-growinginternational-crow>> 2 pages.

Affidavit of Jenny Hsu—Attachment D, "HCT's patented cooling tip technology wins award for Clinique Lid Smoothies" BeautyPackaging Magazine, Oct. 2012, Press release, HCT Innovation on demand, 3 pages.

Affidavit of Jenny Hsu—Attachment E, "HCT Develops Dispensing Concept: Zamac Tips Add a High Dose of Cool," Beauty Packaging Magazine, Oct./Nov. 2009, retrieved at <<http://www.beautypackaging.com/articles/2009/10/design-center>> 3 pages.

Affidavit of Jenny Hsu, including Exhibits A-I, State of California, county of Lost Angeles, Jan. 2013, 26 pages.

"Blistex—Lip Splash, Rolling Tip Applicator, Lip Moisturizer, SPF for Your Lips, Dermat . . . ", retrieved on May 10, 2007 at <http://www.blistex.eu/whats_new.htm>, 1 page.

"Communication Accompanying Information Disclosure Statement," for U.S. Appl. No. 13/656,993, Timothy Thorpe, "Dispenser With Thermal Storage Tip," May 14, 2013, 2 pages.

"Cosmogen Innovation in Progress . . . Squeeze'n Roll," retrieved on Jun. 20, 2008, 1 page.

"Energizer L91 Ultimate Lithium", Product Datasheet, retrieved on Feb. 5, 2013, at <<http://data.energizer.com/PDFs/I91.pdf>>, Energizer Holdings, Inc., pp. 1-2.

"Frequently Asked Questions About Our Cooling and Heating Technology", retrieved on Feb. 5, 2013, at <<http://www.tellurex.com/technology/peltier-faq.php>>, Tellurex, 2009-2011, pp. 1-14.

HCT Answer Brief to Third Korean Invalidation Brief (Summary Translation), filed Apr. 29, 2013, 7 pages.

Lancome Oscillation Powderfoundation, retrieved on Mar. 8, 2010, at <<http://www.lancome-usa.com/makeup/foundations/oscillation-powerfoundation.aspx>>, p. 1 of 1.

"Part Number: CP Series, Description: application notes", V-Infinity, a division of CUI, Inc., Jan. 2009, pp. 1-8.

Response to Korean Invalidation Petition (and Summary Translation) in response to Invalidation Action filed in reference to Korean Patent No. 800040, dated Mar. 25, 2013, 60 pages.

Response to Non-Final Office Action for U.S. Appl. No. 11/747,078, dated Sep. 16, 2010, Timothy Thorpe, "Dispenser with Thermal Storage Tip," 10 pages.

Response to Non-Final Office Action for U.S. Appl. No. 13/022,193, dated Jul. 30, 2012, Timothy Thorpe, "Dispenser with Thermal Storage Tip," 18 Pages.

Sephora, Urban Decay Cosmetics—Loose Pigments Eyeshadow, retrieved on Mar. 11, 2010 at <<http://www.sephora.com/browse/product.jhtml?id=P204729&cm_mmc=us_search-_-GoogleBase-_-P204729-_-1051143&_requestedid=42976&ci_src=14110944&ci_src=14110944&ci_sku=1051143>>, 5 pages.

"Series: CP20, Description: 2.0 A Peltier Module", retrieved on Feb. 5, 2013 at <<http://cui.com/Product/Resource/PDF/CP20.pdf>>, CUI,Inc May 7, 2012, pp. 1-5.

"Super simple PWM TEC controller", retrieved on Feb. 5, 2013, at <<http://redlum.xohp.pagesperso-orange.fr/electronics/simplePWM-TEC.html>>, Welcom to W's Laser-Projects Page!., Vers. 1.0, Aug. 2010. pp. 1-3.

The Notice: a beauty blog "Too much of a good thing is still totally a good thing. | Clinique Almost Lipstick review, photos, swatches (Spring 2012 full lineup)" Posted Feb. 25, 2012. Accessed on Aug. 17, 2015. (http://thenotice.net/2012/02/clinique-almost-lipstick-review/).

The Ultimate Makeup blog "Review & Swatches: NARS Fall 2011 Pure Matte Lipsticks in Montego Bay & Mascate" Posted Aug. 12, 2011. Accessed on Aug. 17, 2015. (http://theultimatemakeup.com/post/8833814342/review-swatches-nars-fall-2011-pure-matte).

(56) References Cited

OTHER PUBLICATIONS

Top Skin Care Products, Facial Skin Care, Skin Care Brush—Clarisonic, retrieved on Mar. 8, 2010 <http://www.clarisonic.com/us/>>, pp. 1-2.
Translated First Korean Invalidation Brief dated Nov. 2, 2012, 7 pages.
Translated Second Korean Invalidation Brief, dated Jan. 23, 2013, 7 pages.
Translated Third Korean Invalidation Brief, dated Mar. 28, 2013, 30 pages.
Response to Final Office Action for U.S. Appl. No. 11/747,078, dated Oct. 28, 2010, Timothy Thorpe, "Dispenser with Thermal Storage Tip," 10 pages.
Beauty and Fashion Tech, "L'Oreal True Match Roller Foundation" retrieved on Jul. 21, 2010 at <<http://www.beautyandfashiontech.com/2010/01/loreal-true-match-roller-foundation.html>>, 8 pages.
CN 3203451, Registered Industrial Design Application (Tianjin Samsun Brushes Ltd.) Oct. 10, 2001.
CN 3401674, Registered Industrail Design Application (Tianhin Samsung Brushed Ltd.), Nov. 3, 2204.
"Givenchy Demesure Audacious Lashes Mascara", May 17, 2011, retrieved from the internet at <<http://www.fashionizers.com/perfumes-makeup/givenchy-demesure-audacious-lashes-mascara/>>, 9 pages.
"Color Wonder Airbrush", Crayola, retrieved on Feb. 20, 2014 at <<http://shop.crayola.com/art-and-craft-supplies/mess-free-coloring/color-wonder-airbrush-7522190000.html>>, 2 pages.
"Marker Airbrush", Crayola, retrieved on Feb. 20, 2015 at <<http://shop.crayola.com/toys/creative-activities/marker-airbrush-0487270001.html>>, 2 pages.
Sure Shot Milwaukee Sprayer, retrieved from <<http://www.sureshotsprayer.com/AtomizersSprayers.html>> on Jan. 7, 2014, 2 pages.

* cited by examiner

ROLLER APPLICATOR

CROSS REFERENCE TO RELATED APPLICATIONS

The present patent application claims the benefit of and priority to U.S. Provisional Patent Application No. 62/244,379, filed Oct. 21, 2015, and U.S. Provisional Patent Application No. 62/191,228, filed Jul. 10, 2015, each titled ROLLER APPLICATOR, the disclosures of which are incorporated herein by reference.

FIELD

The present application relates to the field of apparatuses for applying cosmetic products.

BACKGROUND

There are numerous applicators for cosmetic products available. Some such applicators include a reservoir for holding a product to be applied, and a delivery portion for applying product as needed by the user. New and alternative approaches to such applicators are desired.

Overview

In an illustrative example, an applicator for a cosmetic product is provided including a cap, and a body, the body comprising a roller, an applicator insert to hold the roller, a collar configured for mating with the cap, a spring coupling the applicator insert to the collar, a portion for holding product, and a wicking agent. The roller, applicator insert, collar, spring, portion for holding product, and wicking agent are sized and configured to define a first configuration when the cap is applied and engaged to the collar in which the spring is in a compressed state such that the applicator insert is moved to a first juxtaposition and the roller is brought adjacent to or in contact with the wicking agent to deliver product to the roller, and a second configuration when the cap is not applied in which the spring is in an extended state such that the applicator insert is moved to a second juxtaposition and the roller is separated from the wicking agent.

In another example, in the second configuration, the roller being separated from the wicking agent limits a quantity of product that may be applied without replacing the cap and effecting the first configuration.

In another example, the roller is a ball.

In another example, the applicator insert includes a recess configured to receive the ball, and a ridge configured to retain the ball within the recess, the recess and ridge configured to retain the ball while allowing the ball to rotate freely.

In another example, the roller is a wheel.

In a further example, the applicator insert includes a slot configured to receive the wheel, and a pin configured to retain the wheel within the slot while allowing the wheel to rotate freely.

In another illustrative example, an applicator for a cosmetic product comprises a reservoir for holding the cosmetic product, a collar disposed with an opening of the reservoir, a spring disposed within the collar, an applicator insert having a first end disposed within the spring and extending into the collar, a roller movably fixed to a second end of the applicator insert, an elongate wicking agent disposed within the reservoir and extending through the collar, the spring, and into the applicator insert, and a cap configured for mating with the collar, wherein the reservoir, collar, spring, applicator insert, roller, wicking agent, and cap are configured such that when the cap is engaged with the collar, the cap moves the applicator insert toward the reservoir, thereby compressing the spring and moving the roller into contact with the wicking agent, allowing the cosmetic product to move from the reservoir, through the wicking agent, and into contact with the roller, and when the cap is removed from the collar, the spring relaxes into an extended position, moving the applicator insert away from the reservoir and moving the roller out of contact with the wicking agent.

In another example, the roller is configured to dispense a limited amount of the cosmetic product as the roller is moved against a surface, wherein the limited amount is limited to product in contact with the roller when the cap was removed.

In another example, the roller is configured to receive an additional amount of cosmetic product when the cap is engaged with the collar, moving the roller into contact with the wicking agent.

In another example, the cap has internal ridges that engage ridges on the applicator insert.

In another example, the wicking agent is fixed relative to the reservoir.

In another example, the roller is a ball.

In another example, the roller is a wheel.

In another example, the roller is absorbent.

In another example, the roller is non-absorbent.

In another example, the roller includes one or more dimples in a surface thereof.

In another example, the roller includes a flocking material on a surface thereof.

In another illustrative example, a method of applying a cosmetic product comprises loading cosmetic product onto a roller by placing a cap onto a collar of a cosmetic container thereby engaging the roller with a wicking agent, the cosmetic container including a reservoir for holding the cosmetic product, the collar disposed with an opening of the reservoir, a spring disposed within the collar, an applicator insert having a first end disposed within the spring and extending into the collar, the roller movably fixed to a second end of the applicator insert, the wicking agent disposed within the reservoir and extending through the collar, the spring, and into the applicator insert, and the cap configured for mating with the collar. The method further comprises removing the cap thereby limiting an amount of the cosmetic product loaded onto the roller, and dispensing the limited amount of cosmetic product by rolling the roller onto a user's skin.

In another example, dispensing the limited amount of cosmetic product includes rolling the roller onto skin until the limited amount of product is dispensed, the method further comprising replacing the cap onto the collar to load a second amount of product onto the roller.

In another example, after replacing the cap, the method further comprises removing the cap and dispensing the second amount of product.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
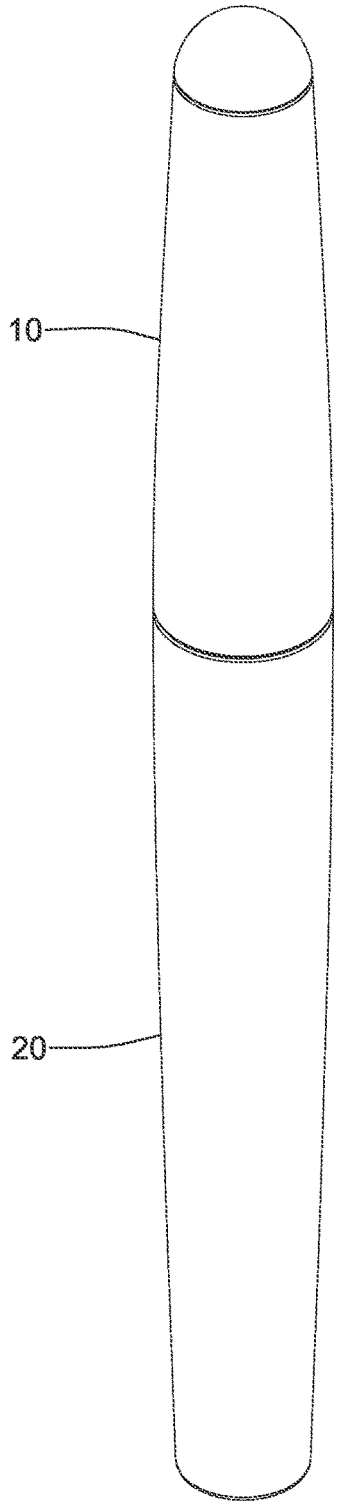
FIG. 1 shows an applicator having the cap thereon.
Figure 2:
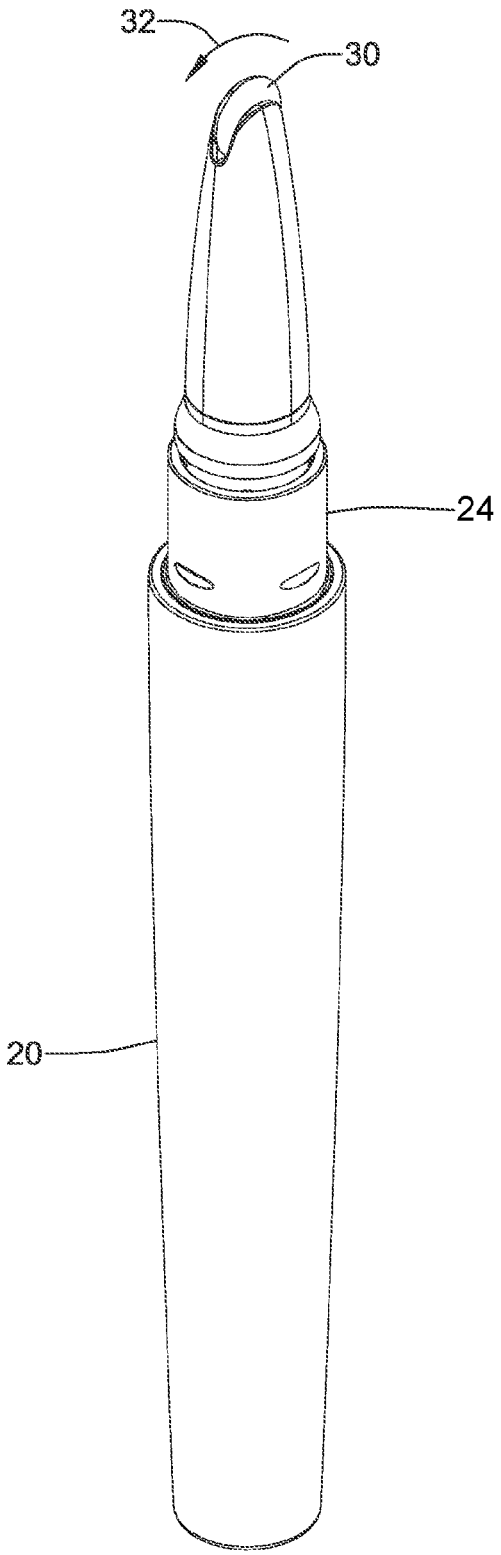
FIG. 2 shows the applicator of FIG. 1 without the cap.

FIG. 1 shows an applicator having a cap thereon. The applicator includes a body 20 and a cap 10. As shown in FIG. 2, the body 20 further includes an applicator portion having a roller 30, which is depicted as a wheel. The roller 30 may be made of an absorbent material such as a felt, or a non-absorbent material such as rubber. The roller 30 may have dimples or ridges, for example, for enhanced product carrying. The roller 30 may instead be a ball, such as a metal, rubber, silicon or other material, again including, in some examples, one or more of dimples, ridges or a pattern to carry product. Flocking may be applied as well or instead of any of these design elements for carrying product. The roller 30 is adapted to move, for example as illustrated by arc 32, as the applicator portion is moved across a portion of the user's body, such as the skin, to apply product that is received from the underlying wicking agent 28 (see FIG. 3). An applicator insert 34 secures the wheel in place.

Figure 3:
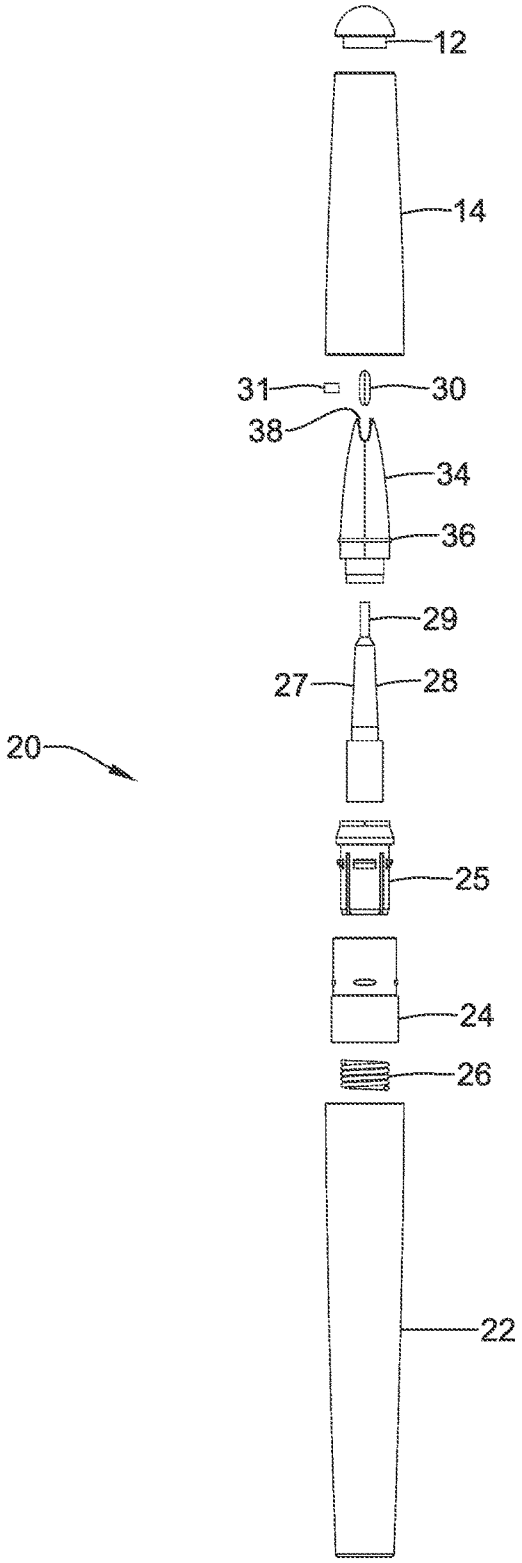
FIG. 3 shows an exploded view of the parts of the applicator of FIGS. 1 and 2.

FIG. 3 shows an exploded view of the applicator. The cap 10 includes an optional cap insert 12, which may be glued, screwed or otherwise affixed to the cap body 14. The cap insert 12 may be in the form of a brand logo or other decorative design.

The body 20 includes the roller 30, again depicted as a wheel. The roller 30 is secured in place to the applicator insert 34, which may have a receiver 38, such as a recess, pocket, groove, slot, etc., for the roller 30. The receiver 38 is configured to hold the roller 30 at the end of the applicator insert 34 while allowing the roller 30 to roll or rotate. The roller 30 may have integrated therein or attached thereto a pin 31 for being received by the applicator insert 34, or a separate pin may be provided. If the roller 30 is a ball, then the receiver 38 may include a collar, lip, ridge, or other structure to secure a ball in place while allowing rotation of the ball.

The lower portion of the body 20 includes a base 22 which serves as a reservoir for product. A collar 24 is disposed within an upper opening in the base, with a spring 26 for loading inside the collar. The spring 26 slides over the lower portion of the applicator insert 34, allowing the applicator insert 34 to be axially moveable relative to the collar 24 and base 22.

A wicking agent 28, which may be an elongated piece of absorbent material such as felt, for example, is provided for extending from the interior of the applicator insert 34, adjacent the receiver 38, into the base 22. The wicking agent 28 may be fixed to an inner collar 25 disposed within the collar 24. In other examples, the wicking agent 28 may be fixed to the collar 24 or the base 22. In some examples, the inner collar 25 may be combined with the applicator insert 34 as a single piece. The wicking agent 28 is fixed relative to the base 22 such that applying the cap 10 onto the base 22 or removing the cap 10 from the base 22 does not change the position of the wicking agent 28.

The wicking agent brings product up from the base 22 to the interior of the applicator insert 34. The length of the wicking agent 28 is such that, when the spring 26 is in an extended state, such as when the cap 10 is removed, the roller 30 is separated from the wicking agent 28. In other examples, the wicking agent may include a product reservoir 27 with an absorbent tip 29. The product reservoir 27 with absorbent tip 29 may be a replaceable cartridge, allowing the applicator to be refillable. For such examples, the replaceable cartridge may extend into the base 22 such that, rather than the base 22 serving as a reservoir for product, it may be a receptacle for the cartridge.

When the cap 10 is applied, it will push the applicator insert 34 toward the base 22 as the cap 10 engages the collar 24. The cap 10 may engage the collar 24 by an interference fit, a snap fit, or by screwing thereon, with the latter two of these configurations providing enhanced control of the engagement of the wicking agent 28 and the roller 30. Ridges 36 on the outer surface of the applicator insert 34 may interact with elements such as ridges on the interior of the cap 10 to depress the applicator insert 34, compressing the spring 26 to a compressed state, relative to the collar 24, bringing the roller 30 into adjacency or contact with the wicking agent 28, applying product to the roller 30 for delivery to the user after the cap 10 is removed. In another example, the inner surface of the cap 10 may be tapered or include tapered elements such that when the cap 10 is pushed onto the tapered applicator insert 34, the cap 10 pushes the applicator insert 34 toward the base 22, placing the roller 30 into contact with the wicking agent 28. The roller 30 is in contact with the wicking agent 28 only when the cap 10 is engaged with the collar 24. Once the cap 10 is removed from the base 22, the spring 26 pushes the applicator insert 34 upwards, separating the roller 30 from the top of the wicking agent 28.

By the above sequence, in some examples, the roller 30 is separated from the wicking agent 28 when the cap 10 is removed, such that the quantity of product that may be delivered or applied without replacing and removing the cap is limited. Once the limited quantity of product that has been loaded onto the roller 30 has been dispensed, the cap must be replaced onto the collar 24 in order for an additional amount of product to be loaded onto the roller 30.

As an alternative, the base 22 may serve as a chamber to receive a replaceable product container. By, for example, removing the collar 24, such a replaceable product container could be accessed, removed, and replaced. In this design, the wicking agent 28 can be integral to the replaceable product container. Alternatively, the wicking agent 28 can be permanently affixed relative to collar 24, such that only the replaceable product container is swapped out.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An applicator for a cosmetic product comprising:
a cap; and
a body, the body comprising:
a roller;
an applicator insert to hold the roller;
a collar configured for mating with the cap;
a spring coupling the applicator insert to the collar;
a portion for holding product; and
a wicking agent;
wherein the roller, applicator insert, collar, spring, portion for holding product, and wicking agent are sized and configured to define:
a first configuration when the cap is applied and engaged to the collar in which the spring is in a compressed state such that the applicator insert is moved to a first juxtaposition and the roller is brought adjacent to or in contact with the wicking agent to deliver product to the roller; and
a second configuration when the cap is not applied in which the spring is in an extended state such that the applicator insert is moved to a second juxtaposition and the roller is separated from the wicking agent.

2. The applicator of claim 1 wherein, in the second configuration, the roller being separated from the wicking agent limits a quantity of product that may be applied without replacing the cap and effecting the first configuration.

3. The applicator of claim 1, wherein the roller is a ball.

4. The applicator of claim 3, wherein the applicator insert includes a recess configured to receive the ball, and a ridge configured to retain the ball within the recess, the recess and ridge configured to retain the ball while allowing the ball to rotate freely.

5. The applicator of claim 1, wherein the roller is a wheel.

6. The applicator of claim 5, wherein the applicator insert includes a slot configured to receive the wheel, and a pin configured to retain the wheel within the slot while allowing the wheel to rotate freely.

7. An applicator for a cosmetic product comprising:
a reservoir for holding the cosmetic product;
a collar disposed with an opening of the reservoir;
a spring disposed within the collar;
an applicator insert having a first end disposed within the spring and extending into the collar;
a roller movably fixed to a second end of the applicator insert;
an elongate wicking agent disposed within the reservoir and extending through the collar, the spring, and into the applicator insert; and
a cap configured for mating with the collar, wherein the reservoir, collar, spring, applicator insert, roller, wicking agent, and cap are configured such that:
when the cap is engaged with the collar, the cap moves the applicator insert toward the reservoir, thereby compressing the spring and moving the roller into contact with the wicking agent, allowing the cosmetic product to move from the reservoir, through the wicking agent, and into contact with the roller; and
when the cap is removed from the collar, the spring relaxes into an extended position, moving the applicator insert away from the reservoir and moving the roller out of contact with the wicking agent.

8. The applicator of claim 7, wherein the roller is configured to dispense a limited amount of the cosmetic product as the roller is moved against a surface, wherein the limited amount is limited to product in contact with the roller when the cap was removed.

9. The applicator of claim 8, wherein the roller is configured to receive an additional amount of cosmetic product when the cap is engaged with the collar, moving the roller into contact with the wicking agent.

10. The applicator of claim 7, wherein the cap has internal ridges that engage ridges on the applicator insert.

11. The applicator of claim 7, wherein the wicking agent is fixed relative to the reservoir.

12. The applicator of claim 7, wherein the roller is a ball.

13. The applicator of claim 7, wherein the roller is a wheel.

14. The applicator of claim 7, wherein the roller is absorbent.

15. The applicator of claim 7, wherein the roller is non-absorbent.

16. The applicator of claim 7, wherein the roller includes one or more dimples in a surface thereof.

17. The applicator of claim 7, wherein the roller includes a flocking material on a surface thereof.

18. A method of applying a cosmetic product, comprising:
loading cosmetic product onto a roller by placing a cap onto a collar of a cosmetic container thereby engaging the roller with a wicking agent, the cosmetic container including:
a reservoir for holding the cosmetic product;
the collar disposed with an opening of the reservoir;
a spring disposed within the collar;
an applicator insert having a first end disposed within the spring and extending into the collar;

the roller movably fixed to a second end of the applicator insert;

the wicking agent disposed within the reservoir and extending through the collar, the spring, and into the applicator insert; and the cap configured for mating with the collar;

removing the cap thereby limiting an amount of the cosmetic product loaded onto the roller; and dispensing the limited amount of cosmetic product by rolling the roller onto a user's skin.

19. The method of claim 18, wherein dispensing the limited amount of cosmetic product includes rolling the roller onto skin until the limited amount of product is dispensed, the method further comprising replacing the cap onto the collar to load a second amount of product onto the roller.

20. The method of claim 19, wherein after replacing the cap, the method further comprises removing the cap and dispensing the second amount of product.

* * * * *